US009288591B1

(12) United States Patent
Dong et al.

(10) Patent No.: US 9,288,591 B1
(45) Date of Patent: Mar. 15, 2016

(54) BONE-CONDUCTION ANVIL AND DIAPHRAGM

(71) Applicants: Jianchun Dong, Mountain View, CA (US); Mitchell Heinrich, Mountain View, CA (US); John Stuart Fitch, Mountain View, CA (US); Matthew Martin, Mountain View, CA (US); Eliot Kim, Mountain View, CA (US)

(72) Inventors: Jianchun Dong, Mountain View, CA (US); Mitchell Heinrich, Mountain View, CA (US); John Stuart Fitch, Mountain View, CA (US); Matthew Martin, Mountain View, CA (US); Eliot Kim, Mountain View, CA (US)

(73) Assignee: Google Inc., Mountain View, CA (US)

( * ) Notice: Subject to any disclaimer, the term of this patent is extended or adjusted under 35 U.S.C. 154(b) by 611 days.

(21) Appl. No.: 13/629,944

(22) Filed: Sep. 28, 2012

Related U.S. Application Data

(60) Provisional application No. 61/610,925, filed on Mar. 14, 2012.

(51) Int. Cl.

| | |
|---|---|
| ***H04R 25/00*** | (2006.01) |
| ***H04R 11/00*** | (2006.01) |
| ***H04R 11/02*** | (2006.01) |
| ***H04R 13/00*** | (2006.01) |

(52) U.S. Cl.
CPC ..... *H04R 25/606* (2013.01); *H04R 11/00* (2013.01); *H04R 11/02* (2013.01); *H04R 13/00* (2013.01); *H04R 2225/67* (2013.01); *H04R 2400/03* (2013.01); *H04R 2460/13* (2013.01)

(58) Field of Classification Search
CPC ..... H04R 1/14; H04R 11/00; H04R 11/02; H04R 11/06; H04R 13/00; H04R 25/00; H04R 25/606; H04R 2225/67; H04R 2460/13; H04R 2499/11; H04R 2400/03
USPC ..... 381/326, 151, 380, 190, 396, 412, 417, 381/322, 327, 328, 330, 381; 455/90.3, 455/550.1, 575.1
See application file for complete search history.

(56) References Cited

U.S. PATENT DOCUMENTS

| | | | | |
|---|---|---|---|---|
| 2,482,044 | A * | 9/1949 | Vernier | 381/151 |
| 4,628,907 | A | 12/1986 | Epley | |
| 5,338,287 | A | 8/1994 | Miller et al. | |
| 6,668,065 | B2 | 12/2003 | Lee et al. | |
| 7,292,695 | B2 * | 11/2007 | Kobayashi | 381/151 |
| 7,499,555 | B1 | 3/2009 | Isvan | |
| 7,512,425 | B2 * | 3/2009 | Fukuda | 455/575.1 |
| 7,564,988 | B2 | 7/2009 | Azima et al. | |
| 7,668,325 | B2 | 2/2010 | Puria et al. | |

(Continued)

FOREIGN PATENT DOCUMENTS

WO 2010033932 A1 3/2010

*Primary Examiner* — Huyen D Le
(74) *Attorney, Agent, or Firm* — McDonnell Boehnen Hulbert & Berghoff LLP

(57) ABSTRACT

Disclosed herein are methods and apparatuses for the transmission of audio information from a bone-conduction headset to a user. The bone-conduction headset may be mounted on a glasses-style support structure. The bone-conduction transducer may be mounted near where the glasses-style support structure approach a wearer's ears. In one embodiment, an apparatus has a bone-conduction transducer with a diaphragm configured to vibrate based on a magnetic field. The magnetic field being based off an applied electric field. The apparatus may also have an anvil coupled to the diaphragm. The anvil may be configured to conduct the vibration from the bone-conduction transducer. Additionally, the anvil may be coupled to a metallic component. The metallic component may be configured to couple to a magnetic field created by the bone-conduction transducer.

18 Claims, 6 Drawing Sheets

(56) References Cited

U.S. PATENT DOCUMENTS

| | | | | |
|---|---|---|---|---|
| 7,680,292 | B2 | 3/2010 | Warren et al. | |
| 2007/0053542 | A1 * | 3/2007 | Lee | 381/380 |
| 2007/0191673 | A1 | 8/2007 | Ball et al. | |
| 2007/0282397 | A1 | 12/2007 | Ball et al. | |
| 2008/0255406 | A1 | 10/2008 | Ball et al. | |
| 2009/0022350 | A1 * | 1/2009 | Asseily et al. | 381/355 |
| 2009/0247814 | A1 | 10/2009 | Parker | |
| 2009/0253951 | A1 | 10/2009 | Ball et al. | |
| 2010/0145135 | A1 | 6/2010 | Ball et al. | |
| 2012/0029267 | A1 | 2/2012 | Ball | |

* cited by examiner

BONE-CONDUCTION ANVIL AND DIAPHRAGM

CROSS REFERENCE TO RELATED APPLICATION

The present application claims priority to U.S. Patent Application Ser. No. 61/610,925, filed on Mar. 14, 2012, the entire contents of which are herein incorporated by reference.

BACKGROUND

Unless otherwise indicated herein, the materials described in this section are not prior art to the claims in this application and are not admitted to be prior art by inclusion in this section.

Computing devices such as personal computers, laptop computers, tablet computers, cellular phones, and countless types of Internet-capable devices are increasingly prevalent in numerous aspects of modern life. Over time, the manner in which these devices are providing information to users is becoming more intelligent, more efficient, more intuitive, and/or less obtrusive.

The trend toward miniaturization of computing hardware, peripherals, as well as of sensors, detectors, and image and audio processors, among other technologies, has helped open up a field sometimes referred to as "wearable computing." In the area of image and visual processing and production, in particular, it has become possible to consider wearable displays that place a very small image display element close enough to a wearer's (or user's) eye(s) such that the displayed image fills or nearly fills the field of view, and appears as a normal sized image, such as might be displayed on a traditional image display device. The relevant technology may be referred to as "near-eye displays."

Near-eye displays are one component of wearable computing devices, also sometimes called "head-mounted devices" (HMDs). A head-mounted device may also include components to create audio signals. The audio signals may be used to listen to music or provide information to a wearing of the head-mounted device. Further, a head-mounted device may have a speaker that transmits audio to a user.

SUMMARY

Disclosed herein are methods and apparatuses for the transmission of audio information from a bone-conduction headset to a user. The bone-conduction headset may be mounted on a glasses-style support structure. The bone-conduction transducer may be mounted near where the glasses-style support structure approaches a wearer's ears. In one embodiment, an apparatus has a bone-conduction transducer with a diaphragm configured to vibrate based on a magnetic field. The magnetic field may be based off an applied electric field. The apparatus may also have an anvil coupled to the diaphragm. The anvil may be configured to conduct the vibration from the bone-conduction transducer.

In a further embodiment, the anvil may have at least one metallic component configured to couple the magnetic field of the bone-conduction transducer. The metallic component may be coupled to the anvil. The anvil may additionally be coupled (directly or via the metallic component) to the external surface of the diaphragm. The external surface of the diaphragm may form an external surface of the bone-conduction transducer.

In some embodiments, the metallic component may be a magnet. The metallic component may be designed to alter the frequency response and/or the acoustic impedance of the bone-conduction transducer. Additionally, the acoustic impedance of the bone-conduction transducer, including the metallic component, is chosen based on an acoustic impedance of a human head. In some additional embodiments, the system may feature a second bone-conduction transducer mounted on a second side section of the support structure.

DETAILED DESCRIPTION

Figure 1A:
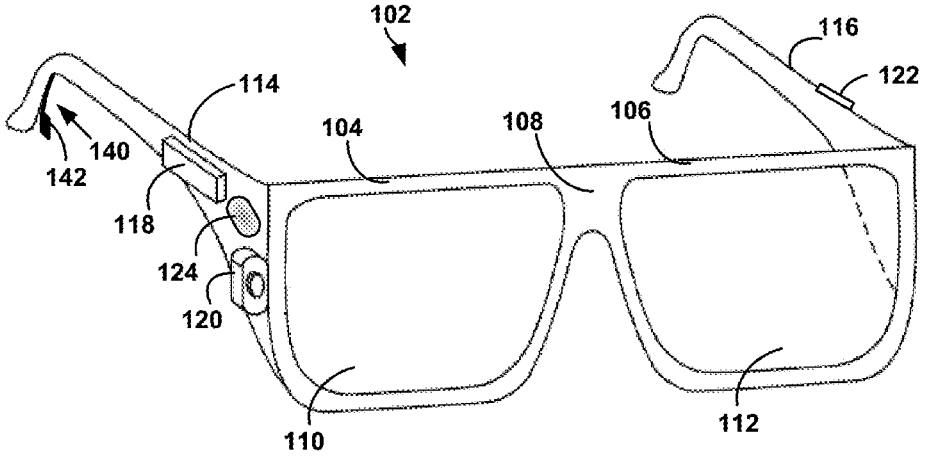
FIG. 1A illustrates a wearable computing system according to an example embodiment.

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

I. Overview

One example embodiment may be implemented in a wearable computer having a head-mounted device (HMD), or more generally, may be implemented on any type of device having a glasses-like form factor. In other embodiments, the HMD may be similar to glasses, but without having lenses. Further, an example embodiment involves an ear-piece with a bone-conduction transducer (e.g., a vibration transducer) mounted on a glasses-style support structure, such that when the support structure is worn, the ear-piece contacts the bone-conduction transducer to the bone structure of the wearer's head. For instance, the ear-piece may be located on the hook-like section of a side arm, which extends behind a wearer's ear and helps keep the glasses in place. Accordingly, the ear-piece may extend from the side arm to contact the back of the wearer's ear at the auricle, for instance. In some additional embodiments, the ear-piece may be located on the side arm itself.

The bone-conduction transducer features an electromechanical transducer coupled to an anvil. The electromechanical transducer is configured to generate a vibration in a diaphragm portion of the transducer in response to an applied electrical signal. The electrical signal is representative of audio to be conducted to a wearer. The electromechanical transducer further features an anvil configured to conduct the vibrations of the diaphragm to a wearer of the glasses.

In another aspect, a bone-conduction transducer may include: (i) the anvil being physically connected to the diaphragm; and (ii) the anvil having a hole or other means allowing it to be physically connected to the diaphragm. A hole or passage in the anvil allows a laser to weld the anvil to a surface of the diaphragm. Additionally, the anvil may be connected with a skin, such as an elastomer, to prevent moisture and debris from entering the bone-conduction transducer.

In another aspect, a bone-conduction transducer may include the anvil having a metallic component embedded within. The metallic component being configured to couple to an electric or magnetic field created by an electrical audio signal in the transducer. The coupling between the magnetic component in the anvil and the electric or magnetic field may alter the acoustic characteristics of the audio output from the anvil. Additionally, the metallic component may be selected to alter the acoustic characteristics to change the frequency response of the bone-conduction transducer.

By including a metallic component, the acoustic properties of the transducer may be altered to be more desirable. For example, the metallic component may enable more of the sound produced by the transducer to be conducted to the head of the wearer. In another example, the metallic component may alter which audio frequencies are conducted. The metallic component may be used to tune the audio properties to a specific wearer.

In another aspect, the ear-piece may be spring-loaded so that the bone-conduction transducer fits comfortably and securely against the back of the wearer's ear. For instance, the ear-piece may include an extendable member, which is connected to the glasses on one end and is connected to the bone-conduction transducer on the other end. A spring mechanism may accordingly serve to hold the end of the member having the bone-conduction away from side-arm when the glasses are not being worn. In other embodiments, the ear-piece may be located on the stem of the glasses-style support to contact the head near the wearer's ear. Various placements of the ear piece may be used with the methods and apparatuses disclosed herein.

In yet another aspect, the ear-piece may be located in a device that is not directly part of the headset, but rather a device that attaches to one (or both) of the side stems of a glasses-like form factor. The device may be removable from the side stems of the glasses-like form factor II. An Example Wearable Computing Device Systems and devices in which example embodiments may be implemented will now be described in greater detail. In general, an example system may be implemented in or may take the form of a wearable computer. However, an example system may also be implemented in or take the form of other devices, such as a mobile phone, among others. Further, an example system may take the form of non-transitory computer readable medium, which has program instructions stored thereon that are executable by at a processor to provide the functionality described herein. An example, system may also take the form of a device such as a wearable computer or mobile phone, or a subsystem of such a device, which includes such a non-transitory computer readable medium having such program instructions stored thereon.

FIG. 1A illustrates a wearable computing system according to an example embodiment. In FIG. 1A, the wearable computing system takes the form of a head-mounted device (HMD) 102 (which may also be referred to as a head-mounted device). It should be understood, however, that example systems and devices may take the form of or be implemented within or in association with other types of devices, without departing from the scope of the disclosure. As illustrated in FIG. 1, the head-mounted device 102 comprises frame elements including lens-frames 104, 106 and a center frame support 108, lens elements 110, 112, and extending side-arms 114, 116. The center frame support 108 and the extending side-arms 114, 116 are configured to secure the head-mounted device 102 to a user's face via a user's nose and ears, respectively.

Each of the frame elements 104, 106, and 108 and the extending side-arms 114, 116 may be formed of a solid structure of plastic and/or metal, or may be formed of a hollow structure of similar material so as to allow wiring and component interconnects to be internally routed through the head-mounted device 102. Other materials may be possible as well.

One or more of each of the lens elements 110, 112 may be formed of any material that can suitably display a projected image or graphic. Each of the lens elements 110, 112 may also be sufficiently transparent to allow a user to see through the lens element. Combining these two features of the lens elements may facilitate an augmented reality or heads-up display where the projected image or graphic is superimposed over a real-world view as perceived by the user through the lens elements.

The extending side-arms 114, 116 may each be projections that extend away from the lens-frames 104, 106, respectively, and may be positioned behind a user's ears to secure the head-mounted device 102 to the user. The extending side-arms 114, 116 may further secure the head-mounted device 102 to the user by extending around a rear portion of the user's head. Additionally or alternatively, for example, the HMD 102 may connect to or be affixed within a head-mounted helmet structure. Other possibilities exist as well.

The HMD 102 may also include an on-board computing system 118, a video camera 120, a sensor 122, and a finger-operable touch pad 124. The on-board computing system 118 is shown to be positioned on the extending side-arm 114 of the head-mounted device 102; however, the on-board computing system 118 may be provided on other parts of the head-mounted device 102 or may be positioned remote from the head-mounted device 102 (e.g., the on-board computing system 118 could be wire- or wirelessly-connected to the head-mounted device 102). The on-board computing system 118 may include a processor and memory, for example. The on-board computing system 118 may be configured to receive and analyze data from the video camera 120 and the finger-operable touch pad 124 (and possibly from other sensory devices, user interfaces, or both) and generate images for output by the lens elements 110 and 112.

The video camera 120 is shown positioned on the extending side-arm 114 of the head-mounted device 102; however, the video camera 120 may be provided on other parts of the head-mounted device 102. The video camera 120 may be configured to capture images at various resolutions or at different frame rates. Many video cameras with a small form-factor, such as those used in cell phones or webcams, for example, may be incorporated into an example of the HMD 102.

Further, although FIG. 1A illustrates one video camera 120, more video cameras may be used, and each may be configured to capture the same view, or to capture different views. For example, the video camera 120 may be forward facing to capture at least a portion of the real-world view perceived by the user. This forward facing image captured by the video camera 120 may then be used to generate an augmented reality where computer generated images appear to interact with the real-world view perceived by the user.

The sensor 122 is shown on the extending side-arm 116 of the head-mounted device 102; however, the sensor 122 may be positioned on other parts of the head-mounted device 102. The sensor 122 may include one or more of a gyroscope or an accelerometer, for example. Other sensing devices may be included within, or in addition to, the sensor 122 or other sensing functions may be performed by the sensor 122.

The finger-operable touch pad 124 is shown on the extending side-arm 114 of the head-mounted device 102. However, the finger-operable touch pad 124 may be positioned on other parts of the head-mounted device 102. Also, more than one finger-operable touch pad may be present on the head-mounted device 102. The finger-operable touch pad 124 may be used by a user to input commands. The finger-operable touch pad 124 may sense at least one of a position and a movement of a finger via capacitive sensing, resistance sensing, or a surface acoustic wave process, among other possibilities. The finger-operable touch pad 124 may be capable of sensing finger movement in a direction parallel or planar to the pad surface, in a direction normal to the pad surface, or both, and may also be capable of sensing a level of pressure applied to the pad surface. The finger-operable touch pad 124 may be formed of one or more translucent or transparent insulating layers and one or more translucent or transparent conducting layers. Edges of the finger-operable touch pad 124 may be formed to have a raised, indented, or roughened surface, so as to provide tactile feedback to a user when the user's finger reaches the edge, or other area, of the finger-operable touch pad 124. If more than one finger-operable touch pad is present, each finger-operable touch pad may be operated independently, and may provide a different function.

In a further aspect, an ear-piece 140 is attached to the right side-arm 114. The ear-piece 140 includes a bone-conduction transducer 142, which may be arranged such that when the HMD 102 is worn, the bone-conduction transducer 142 is positioned to the posterior of the wearer's ear. Further, the ear-piece 140 may be moveable such that the bone-conduction transducer 142 can contact the back of the wearer's ear. For instance, in an example embodiment, the ear-piece may be configured such that the bone-conduction transducer 142 can contact the auricle of the wearer's ear. Other arrangements of ear-piece 140 are also possible. As shown in some figures, the earpiece 140 may be positioned to the posterior of the wearer's ear. However, the positioning of ear-piece 140 and transducer 142 may be varied. Additionally, the earpiece 140 may be positioned at any other point along a wearer's head to conduct audio. For example, in some embodiments the earpiece may contact the wearer in front of his or her ear.

In an example embodiment, a bone-conduction transducer, such as transducer 142, may take various forms. For instance, a bone-conduction transducer may be implemented with a vibration transducer that is configured as a bone-conduction transducer (BCT). However, it should be understood that any component that is arranged to vibrate a wearer's bone structure might be incorporated as a bone-conduction transducer, without departing from the scope of the disclosure.

Yet further, HMD 102 may include at least one audio source (not shown) that is configured to provide an audio signal that drives bone-conduction transducer 142. For instance, in an example embodiment, an HMD may include a microphone, an internal audio playback device such as an on-board computing system that is configured to play digital audio files, and/or an audio interface to an auxiliary audio playback device, such as a portable digital audio player, smartphone, home stereo, car stereo, and/or personal computer. The interface to an auxiliary audio playback device may be a tip, ring, sleeve (TRS) connector, or may take another form. Other audio sources and/or audio interfaces are also possible.

Figure 1B:
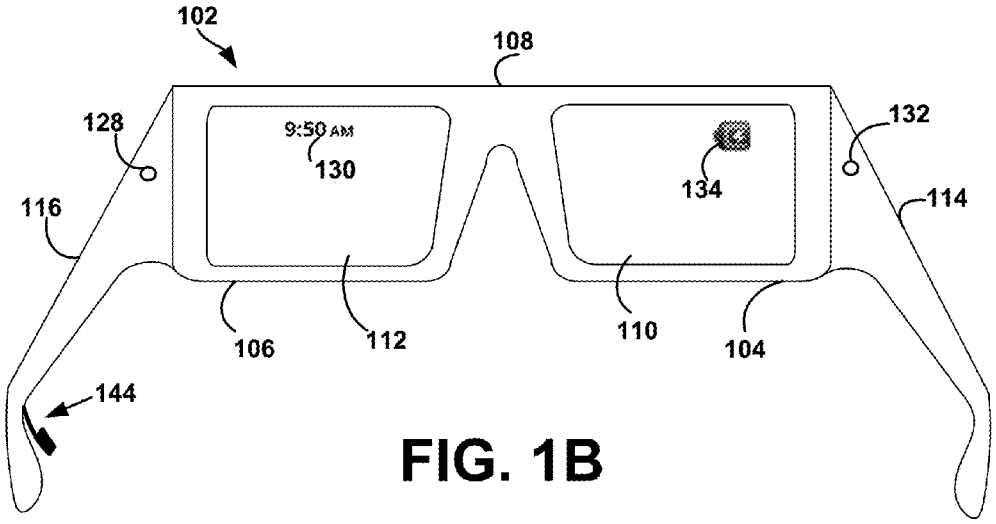
FIG. 1B illustrates an alternate view of the wearable computing device illustrated in FIG. 1A.

FIG. 1B illustrates an alternate view of the wearable computing device illustrated in FIG. 1A. As shown in FIG. 1B, the lens elements 110, 112 may act as display elements. The head-mounted device 102 may include a first projector 128 coupled to an inside surface of the extending side-arm 116 and configured to project a display 130 onto an inside surface of the lens element 112. Additionally or alternatively, a second projector 132 may be coupled to an inside surface of the extending side-arm 114 and configured to project a display 134 onto an inside surface of the lens element 110.

The lens elements 110, 112 may act as a combiner in a light projection system and may include a coating that reflects the light projected onto them from the projectors 128, 132. In some embodiments, a reflective coating may not be used (e.g., when the projectors 128, 132 are scanning laser devices).

In alternative embodiments, other types of display elements may also be used. For example, the lens elements 110, 112 themselves may include: a transparent or semi-transparent matrix display, such as an electroluminescent display or a liquid crystal display, one or more waveguides for delivering an image to the user's eyes, or other optical elements capable of delivering an in focus near-to-eye image to the user. A corresponding display driver may be disposed within the frame elements 104, 106 for driving such a matrix display. Alternatively or additionally, a laser or LED source and scanning system could be used to draw a raster display directly onto the retina of one or more of the user's eyes. Other possibilities exist as well.

In a further aspect, HMD 108 does not include an ear-piece 140 on right side-arm 114. Instead, HMD includes a similarly configured ear-piece 144 on the left side-arm 116, which includes a bone-conduction transducer configured to transfer vibration to the wearer via the back of the wearer's ear.

Figure 1C:
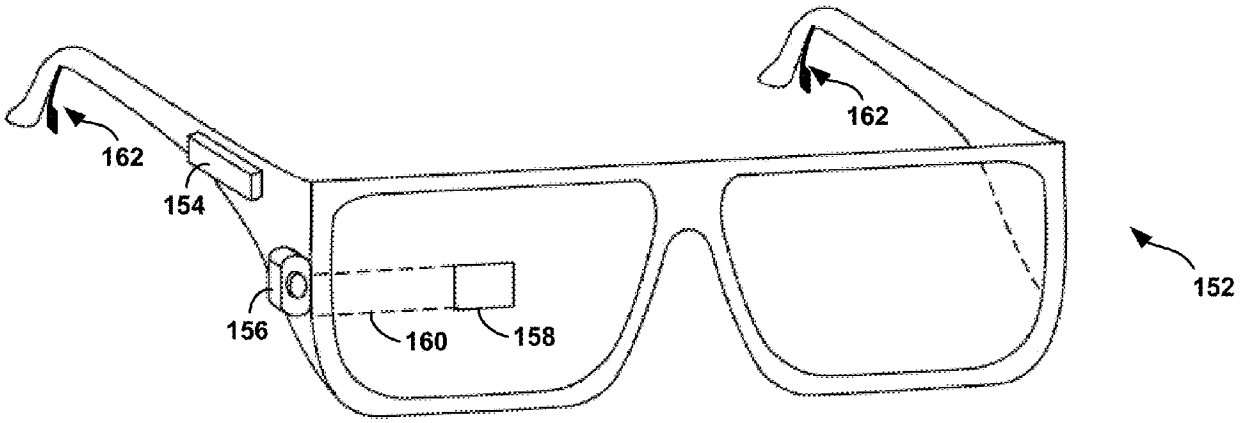
FIG. 1C illustrates another wearable computing system according to an example embodiment.

FIG. 1C illustrates another wearable computing system according to an example embodiment, which takes the form of an HMD 152. The HMD 152 may include frame elements and side-arms such as those described with respect to FIGS. 1A and 1B. The HMD 152 may additionally include an on-board computing system 154 and a video camera 206, such as those described with respect to FIGS. 1A and 1B. The video camera 206 is shown mounted on a frame of the HMD 152. However, the video camera 206 may be mounted at other positions as well.

As shown in FIG. 1C, the HMD 152 may include a single display 158 which may be coupled to the device. The display 158 may be formed on one of the lens elements of the HMD 152, such as a lens element described with respect to FIGS. 1A and 1B, and may be configured to overlay computer-generated graphics in the user's view of the physical world. The display 158 is shown to be provided in a center of a lens of the HMD 152, however, the display 158 may be provided in other positions. The display 158 is controllable via the computing system 154 that is coupled to the display 158 via an optical waveguide 160.

In a further aspect, HMD 152 includes two ear-pieces 162 with bone-conduction transducers, located on the left and right side-arms of HMD 152. The ear-pieces 162 may be configured in a similar manner as ear-pieces 140 and 144. In particular, each ear-piece 162 includes a bone-conduction transducer that is arranged such that when the HMD 152 is worn, the bone-conduction transducer is positioned to the posterior of the wearer's ear. Further, each ear-piece 162 may be moveable such that the bone-conduction transducer can contact the back of the respective ear.

Further, in an embodiment with two ear-pieces 162, the ear-pieces may be configured to provide stereo audio. As such, HMD 152 may include at least one audio source (not shown) that is configured to provide stereo audio signals that drive the bone-conduction transducers 162.

Figure 1D:
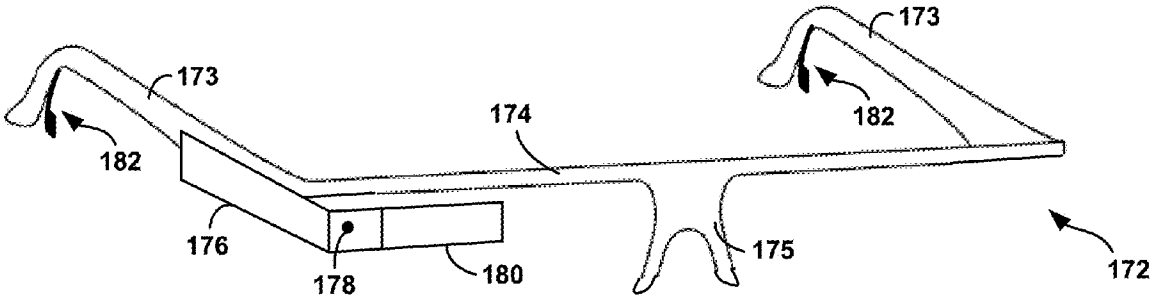
FIG. 1D illustrates another wearable computing system according to an example embodiment.

FIG. 1D illustrates another wearable computing system according to an exemplary embodiment, which takes the form of an HMD 172. The HMD 172 may include side-arms 173, a center frame support 174, and a bridge portion with nose-piece 175. In the example shown in FIG. 1D, the center frame support 174 connects the side-arms 173. The HMD 172 does not include lens-frames containing lens elements. The HMD 172 may additionally include an on-board computing system 176 and a video camera 178, such as those described with respect to FIGS. 1A and 1B.

The HMD 172 may include a single lens element 180 that may be coupled to one of the side-arms 173 or the center frame support 174. The lens element 180 may include a display such as the display described with reference to FIGS. 1A and 1B, and may be configured to overlay computer-generated graphics upon the user's view of the physical world. In one example, the single lens element 180 may be coupled to the inner side (i.e., the side exposed to a portion of a user's head when worn by the user) of the extending side-arm 173. The single lens element 180 may be positioned in front of or proximate to a user's eye when the HMD 172 is worn by a user. For example, the single lens element 180 may be positioned below the center frame support 174, as shown in FIG. 1D.

In a further aspect, HMD 172 includes two ear-pieces 182 with bone-conduction transducers, which are respectively located on the left and right side-arms of HMD 152. The ear-pieces 182 may be configured in a similar manner as the ear-pieces 162 on HMD 152.

Figure 1E:
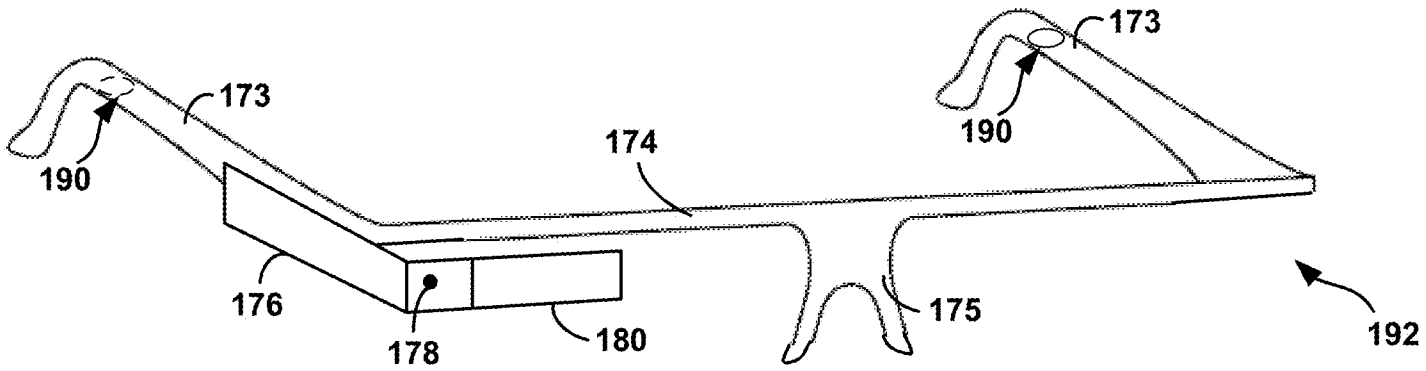
FIG. 1E illustrates another wearable computing system according to an example embodiment.

FIG. 1E illustrates another wearable computing system according to an exemplary embodiment, which takes the form of an HMD 192. The HMD 192 may include side-arms 173, a center frame support 174, and a bridge portion with nose-piece 175. In the example shown in FIG. 1D, the center frame support 174 connects the side-arms 173. The HMD 192 does not include lens-frames containing lens elements. The HMD 192 may additionally include an on-board computing system 176 and a video camera 178, such as those described with respect to FIGS. 1A and 1B.

In a further aspect, HMD 192 includes two ear-pieces 190 with bone-conduction transducers, which are respectively located on the left and right side-arms of HMD 152. The ear-pieces 190 may be configured in a similar manner as the ear-pieces 162 on HMD 152. However, the ear-pieces 190 may be mounted on the frame of the glasses rather than on extensions from the frame. Ear pieces similar to the ear-pieces 190 may be used in place of the ear pieces shown in FIGS. 1A through 1D.

Figure 2:
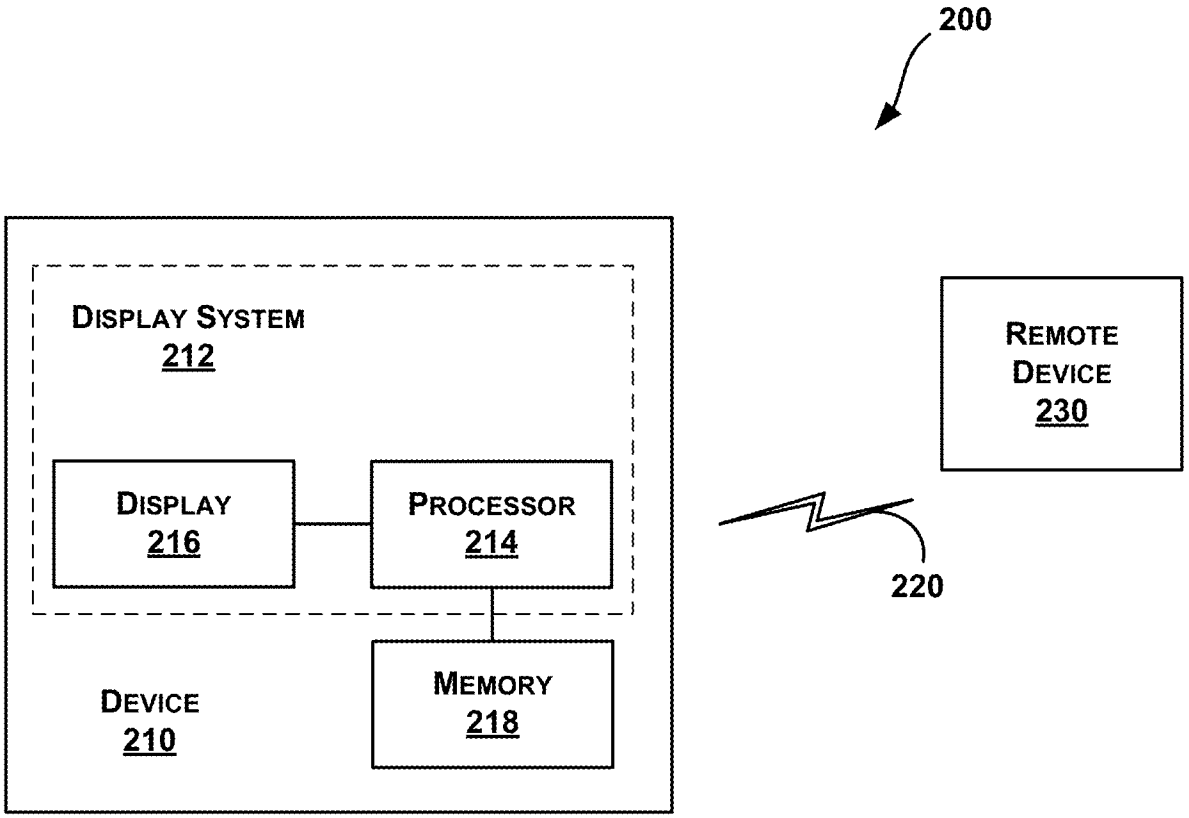
FIG. 2 illustrates a schematic drawing of a computing device according to an example embodiment.

FIG. 2 illustrates a schematic drawing of a computing device according to an example embodiment. In system 200, a device 210 communicates using a communication link 220 (e.g., a wired or wireless connection) to a remote device 230. The device 210 may be any type of device that can receive data and display information corresponding to or associated with the data. For example, the device 210 may be a heads-up display system, such as the head-mounted devices 102, 152, or 172 described with reference to FIGS. 1A-1E.

Thus, the device 210 may include a display system 212 comprising a processor 214 and a display 216. The display 210 may be, for example, an optical see-through display, an optical see-around display, or a video see-through display. The processor 214 may receive data from the remote device 230, and configure the data for display on the display 216. The processor 214 may be any type of processor, such as a microprocessor or a digital signal processor, for example.

The device 210 may further include on-board data storage, such as memory 218 coupled to the processor 214. The memory 218 may store software that can be accessed and executed by the processor 214, for example.

The remote device 230 may be any type of computing device or transmitter including a laptop computer, a mobile telephone, or tablet computing device, etc., that is configured to transmit data to the device 210. The remote device 230 and the device 210 may contain hardware to enable the communication link 220, such as processors, transmitters, receivers, antennas, etc.

In FIG. 2, the communication link 220 is illustrated as a wireless connection; however, wired connections may also be used. For example, the communication link 220 may be a wired serial bus such as a universal serial bus or a parallel bus. A wired connection may be a proprietary connection as well. The communication link 220 may also be a wireless connection using, e.g., Bluetooth® radio technology, communication protocols described in IEEE 802.11 (including any IEEE 802.11 revisions), Cellular technology (such as GSM, CDMA, UMTS, EV-DO, WiMAX, or LTE), or Zigbee® technology, among other possibilities. The remote device 230 may be accessible via the Internet and may include a computing cluster associated with a particular web service (e.g., social-networking, photo sharing, address book, etc.).

III. Bone Conduction Transducer

Figure 3:
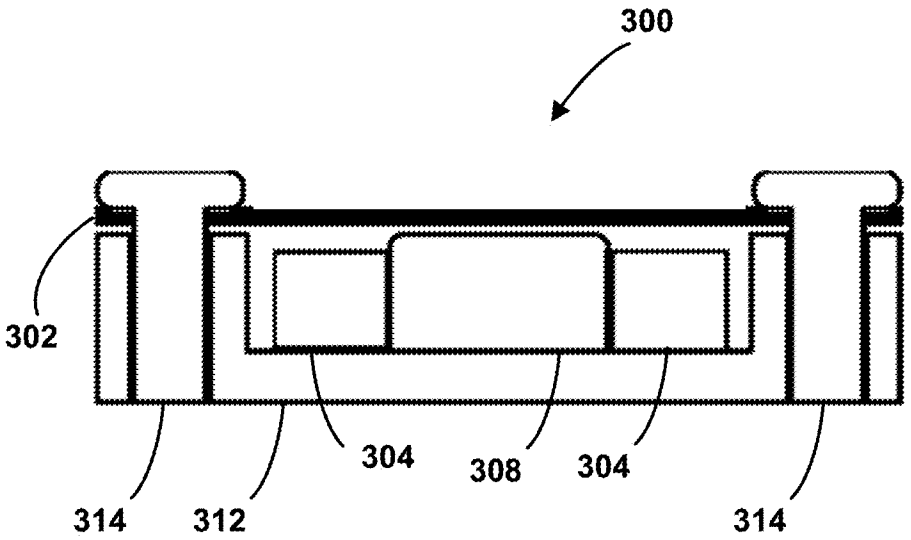
FIG. 3 is a simplified block diagram illustrating an electromagnetic transducer apparatus according to an example embodiment.

FIG. 3 is a simplified block diagram illustrating an electromagnetic transducer apparatus 300 according to an example embodiment. In particular, FIG. 3 shows an electromagnetic transducer 300 with a diaphragm 302 configured to vibrate in response to an electrical signal applied to a coil 304.

An electrical signal representing an audio signal may be fed through a wire coil 304. The audio signal in the coil 304 induces a magnetic field that is time-varying. The induced magnetic field varies proportionally to the audio signal applied to the coil 304. The diaphragm may be held in place by supports 314.

The magnetic field induced by coil 304 may cause a ferromagnetic core 308 to become magnetized. The core 308 may be any ferromagnetic material such as iron, nickel, cobalt, or rare earth metals. In some embodiments, the core 308 may be physically connected to the transducer chassis 312, like as shown in FIG. 3. In other embodiments, the core 308 may be physically connected to the diaphragm 302 (the physical connection is not shown). Additionally, in various embodiments the core 308 is a magnet.

The diaphragm 302 is configured to vibrate based on magnetic field induced by coil 304. The diaphragm 302 may be made of a metal or other metallic substance. When an electrical signal propagates through coil 304 it will induce a magnetic field in the core 308. This magnetic field will couple to the diaphragm 302 and cause diaphragm 302 to responsively vibrate.

The diaphragm 302 may be held in place by supports 314. The supports 314 may be made of a material that allows some motion of the diaphragm 302. For example, the supports 314 may be made of rubber, plastic, or springs. By allowing some movement of the diaphragm, vibrations may more easily be conducted by diaphragm 302.

However, in some embodiments the diaphragm may be made of a non-metallic substance. In embodiments where the diaphragm 302 is non-metallic, the diaphragm 302 may be coupled to a metallic element, such as core 308. For a non-metallic diaphragm 302, the addition of a metallic component, such as core 308, may increase the coupling to a magnetic field created by coil 304. The non-metallic diaphragm 302 coupled to a metallic component may function in a similar manner to the metallic diaphragm described above.

The electromagnetic transducer apparatus 300 is simply one form of transducer for converting an electric signal to a vibration. The methods and apparatuses disclosed herein are not limited to the single style of electromagnetic transducer apparatus 300.

For example, in some embodiments, the transducer apparatus 300 may be a piezoelectric transducer. In many embodiments, any transducer that can convert an electrical signal into a vibration signal may be used for transducer apparatus 300.

Figure 4:
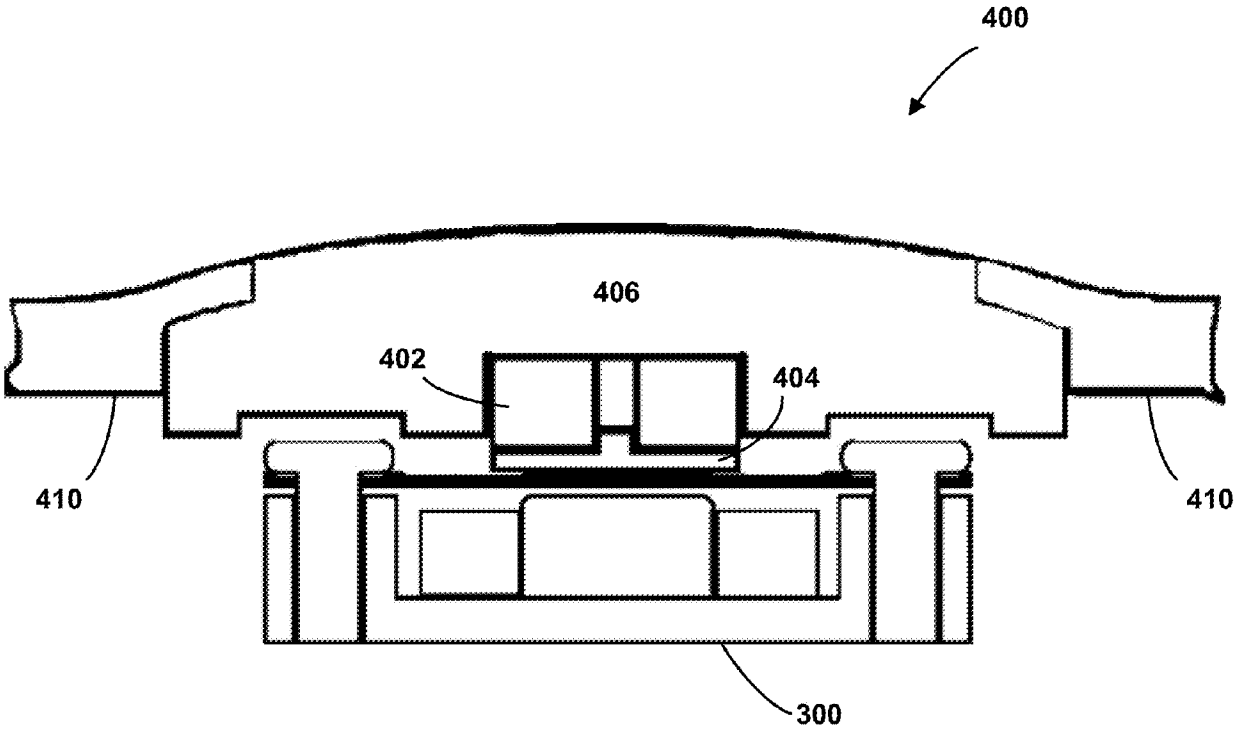
FIG. 4 shows an example bone-conduction apparatus with metallic component.

FIG. 4 shows an example bone-conduction apparatus 400. The bone-conduction apparatus 400 features a transducer apparatus 300 coupled to an anvil 406. FIG. 4 shows a profile view of the transducer. The transducer apparatus 300 may be similar to those described with respect to FIG. 3.

The anvil 406 conducts vibrations from the diaphragm 302 of the transducer 300 to a wearer (not shown in FIG. 4) of the head mounted device. The anvil 406 conducts vibrations from the diaphragm 302 of the transducer 300 to a wearer of the head mounted device. The anvil may be positioned to place pressure on the surface of the skin of the wearer and couple sound into the bones of the head of wearer.

In some embodiments, the anvil 406 may be connected to the head mounted device with a flexible sheath 410. The flexible sheath 410 is configured to allow the anvil 406 to vibrate based on the vibrations of the diaphragm 302. The flexible sheath 410 may be made of plastic, rubber, or another elastomer-type compound. The flexible sheath 410 may be made of a material that does not conduct the vibrations from the anvil 406 to the frame of the head mounted device. Thus, the flexible sheath 410 enables the vibration of the anvil 406 to be conducted to a user wearing the headset, but does not conduct the vibration into the frame of the headset itself.

In some further embodiments, the flexible sheath 410 may extend over the surface of anvil 406. The vibrations conducted from the anvil 406 to the wearer of the head mounted device may be conducted through the flexible sheath 410 if it extends over the top surface of the anvil 406.

In some embodiments, electromagnetic transducer apparatus 300 may be made separately from the anvil 406. Thus, in some embodiments the anvil 406 may be coupled to the diaphragm 302 of the electromagnetic transducer apparatus 300 during manufacture of the head mounted device. In other embodiments, the anvil 406 may be coupled to the diaphragm 302 of the electromagnetic transducer apparatus 300 during manufacture of the electromagnetic transducer apparatus 300.

In one embodiment, either the anvil 406 or the diaphragm 302 or both may have an adhesive surface. When the anvil 406 and the diaphragm 302 are brought in contact, the adhesive may couple the two parts together. Thus, the anvil 406 may vibrate directly based on the vibrations of the diaphragm 302.

In some embodiments, the anvil 406 may alter the impedance on the diaphragm 302. The change in impedance may alter acoustic properties of audio transmission from the electromagnetic transducer apparatus 300. The impedance seen by the diaphragm 302 may be a function of the mass attached to the diaphragm 302. Additionally, the impedance also may be a function of the magnetic properties of a mass attached to the diaphragm 302.

It may be desirable for the impedance of the transducer element 400 to be matched to the impedance of a user's head. The head of a user of the HMD has a mechanical impedance through which the audio from the transducer element 400 must be conducted. As the different in output impedance of the transducer element 400 and the impedence seen by the transducer element 400 increases, the amount of audio conducted decreases. Thus, a matched impedance allows the optimal signal coupling from the transducer to the head of a user of the HMD. The metallic component may be selected in attempt to match the impedance seen by the transducer element 400 to the mechanical impedance of a user's head. Additionally, the metallic component 402 may alter the mass of the anvil 406. The change in mass of the anvil 406 may also change the impedance seen by the diaphragm 302.

In some embodiments, the anvil 406 may include a metallic component 402. The metallic component 402 may couple with the magnetic field created by the electromagnetic transducer apparatus 300. The metallic component 402 may move based on the electromagnetic field from the electromagnetic transducer apparatus 300. For example, the metallic component 402 may vibrate in a similar fashion to the diaphragm 302. In one example, the metallic component 402 vibrates just due to being coupled with the magnetic field created by the electromagnetic transducer apparatus 300. In a second example, the metallic component 402 vibrates due to both being coupled with the magnetic field created by the electromagnetic transducer apparatus 300 as well as being attached to the diaphragm 302. In the second example, the magnetic field coupling may aid in creating the vibration.

By adding a metallic component 402 to the anvil 406, the amount of coupling between vibrating elements (including the diaphragm 302, anvil 406, and metallic component 402) and the electric field created by the electromagnetic transducer apparatus 300 may be increased. This increase in coupling may provide an increase in frequency response characteristics. A metallic component 402 may be chosen based on a desired acoustic frequency response for bone-conduction apparatus 400. For example, a user of the HMD may have a desired frequency response for the conducted audio. A metallic component 402 may be selected to approximate the desired frequency response. In another example, the transducer may be configured to only output specific audio frequencies. The metallic component 402 may be selected to maximize conducted audio across the frequency range that transducer will produce.

Metallic component 402 may be a ferromagnetic component, such as iron. Additionally, in some embodiments, metallic component 402 may be a magnet. However, metallic component 402 may be made of other materials or combinations of materials. Any material that may interact with a magnetic field produced by the electromagnetic transducer apparatus 300 may be used for the metallic component 402. Further, in an example embodiment, the metallic component may be "pill shape," approximately 12 mm×5 mm×1.5 mm.

In some further embodiments, the bone-conduction apparatus 400 may include a mount 404 for the metallic component 402. The mount 404 may be coupled to the diaphragm 302. The mount 404 may provide guidance for the placement of the metallic component 402 within the anvil 406. In other embodiments, the mount 404 may provide guidance for the placement of the metallic component 402 against the diaphragm. The mount may be integrated as a component of the electromagnetic transducer apparatus 300 or it may be a component of the anvil 406. In some embodiments, the mount 404 may be omitted altogether.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. An apparatus comprising:

a support structure having two side-arms;

at least one bone-conduction transducer mounted to at least one of the side-arms, wherein the bone-conduction transducer comprises a diaphragm configured to vibrate in response to a magnetic field generated by the one bone-conduction transducer, and wherein the side-arm positions the bone-conduction transducer to the posterior of a wearer's ear;

a mount coupled to an external surface of the diaphragm;

an anvil coupled to the external surface of the diaphragm, wherein the anvil is configured to conduct the vibration from the diaphragm, and wherein the anvil is coupled to the support structure via a sheath; and at least one metallic component (i) aligned to the mount and (ii) located within the anvil, wherein the metallic component is configured to couple to the magnetic field of the bone-conduction transducer and cause a desired acoustic frequency response for the bone-conduction transducer.

2. The apparatus of claim 1, wherein the metallic component is a magnet.

3. The apparatus of claim 1, wherein the metallic component alters the acoustic impedance of the bone-conduction transducer.

4. The apparatus of claim 3, wherein the acoustic impedance of the bone-conduction transducer is chosen based on an acoustic impedance of a human head.

5. The apparatus of claim 1, wherein the external surface of the diaphragm forms an external surface of the bone-conduction transducer.

6. The apparatus of claim 1, further comprising a second bone-conduction transducer mounted to a second side-arm of the two side arms; and a second anvil coupled to a second diaphragm, wherein the second anvil is configured to conduct the vibration from the second diaphragm, and wherein the second anvil comprises at least one second metallic component configured to couple to a magnetic field of the second bone-conduction transducer.

7. A method comprising:

receiving a signal with a bone-conduction transducer, wherein the bone conduction transducer comprises a diaphragm; and responsive to receiving the signal, the bone conduction transducer creating an electromagnetic field based on the signal and:

coupling the electromagnetic field to a diaphragm; and coupling the electromagnetic field to a metallic component located within an anvil, wherein the anvil is coupled to a side-arm of a support structure via a sheath and is configured to: (i) couple to an external surface of the diaphragm, and (ii) conduct a vibration from the diaphragm, and wherein the metallic component: (i) is aligned to a mount, wherein the mount coupled to the external surface of the diaphragm, and (ii) causes a desired acoustic frequency response for the bone-conduction transducer; and coupling the vibration conducted by the anvil to the posterior of a wearer's ear.

8. The method of claim 7, wherein the metallic component is a magnet.

9. The method of claim 7, wherein the metallic component alters the acoustic impedance of the bone-conduction transducer.

10. The method of claim 9, wherein the acoustic impedance of the bone-conduction transducer is chosen based on an acoustic impedance of a human head.

11. The method of claim 7, wherein the external surface of the diaphragm forms an external surface of the bone-conduction transducer.

12. The method of claim 7, further comprising a second bone-conduction transducer mounted on a second side-arm of the support structure side section; and a second anvil coupled to a second diaphragm, wherein the second anvil is configured to conduct the vibration from the second diaphragm, and wherein the second anvil comprises at least one second metallic component configured to couple to a magnetic field of the second bone-conduction transducer.

13. An apparatus comprising:

a vibration transducer comprising a diaphragm configured to vibrate in response to a magnetic field generated by the one bone-conduction transducer, wherein the vibration transducer is mounted on a side-arm of a head-mounted support structure having two side-arms, and wherein the side-arm positions the bone-conduction transducer to the posterior of a wearer's ear;

an anvil coupled to an external surface of the diaphragm, wherein the anvil is configured to conduct a vibration from the diaphragm, and wherein the anvil is coupled to the support structure via a sheath; and a component coupled within the anvil, wherein the component is aligned to a mount that is coupled to an external surface of the diaphragm, and wherein the component causes a desired acoustic frequency response for the vibration transducer.

14. The apparatus of claim 13, wherein the component is a magnet.

15. The apparatus of claim 13, wherein the component alters the acoustic impedance of the vibration transducer.

16. The apparatus of claim 13, wherein the diaphragm is configured to vibrate based on a magnetic field produced when a signal is applied to the vibration transducer.

17. The apparatus of claim 13, wherein the external surface of the diaphragm forms an external surface of the vibration transducer.

18. The apparatus of claim 13, wherein the component is configured to couple to a magnetic field produced when a signal is applied to the vibration transducer.

* * * * *